US011421908B2

(12) United States Patent
Fettkether

(10) Patent No.: US 11,421,908 B2
(45) Date of Patent: Aug. 23, 2022

(54) OVAL REGISTER BOOT, PIPE, ELBOW, AND CONNECTOR FOR HVAC

(71) Applicant: Fettkether LLC, Readlyn, IA (US)

(72) Inventor: Keith J. Fettkether, Readlyn, IA (US)

(73) Assignee: Fettkether LLC, Readlyn, IA (US)

( * ) Notice: Subject to any disclaimer, the term of this patent is extended or adjusted under 35 U.S.C. 154(b) by 0 days.

(21) Appl. No.: 17/203,253

(22) Filed: Mar. 16, 2021

(65) Prior Publication Data

US 2021/0285685 A1 Sep. 16, 2021

Related U.S. Application Data

(60) Provisional application No. 62/990,322, filed on Mar. 16, 2020.

(51) Int. Cl.
*F24F 13/02* (2006.01)
*F24F 7/00* (2021.01)

(52) U.S. Cl.
CPC ..... *F24F 13/0236* (2013.01); *F24F 13/0218* (2013.01); *F24F 2007/002* (2013.01)

(58) Field of Classification Search
CPC ..... F24F 13/0236; F24F 13/0218; F24F 13/0227; F24F 13/0263; F24F 2007/002; F16L 9/12
USPC ..... 454/330
See application file for complete search history.

(56) References Cited

U.S. PATENT DOCUMENTS 2,131,804 A 10/1938 Holub
3,920,271 A * 11/1975 Bluestone ..... F24F 13/02 285/148.22
3,985,158 A 10/1976 Felter
4,735,235 A 4/1988 Anderson et al.
4,750,411 A 6/1988 Eversole
5,095,942 A 3/1992 Murphy
5,219,403 A 6/1993 Murphy
6,029,505 A 2/2000 Webb
6,173,997 B1 1/2001 Nordstrom et al.
6,203,074 B1 3/2001 Daniel
6,231,704 B1 5/2001 Carpinetti
6,273,145 B1 8/2001 Botting
6,589,277 B1 7/2003 Fabiani et al.
(Continued)

FOREIGN PATENT DOCUMENTS

WO WO-2006119586 A1 * 11/2006 ..... F16L 9/127

*Primary Examiner* — Steven B McAllister
*Assistant Examiner* — Charles R Brawner
(74) *Attorney, Agent, or Firm* — Goodhue, Coleman & Owens, P.C.

(57) ABSTRACT

A system for air handling, the system includes a pipe comprised of plastic having an oval cross-section. The system may further include a register boot comprised of plastic having a main body with a first opening and a second opening wherein the first opening has an oval cross-section for connection with an oval pipe and wherein the second opening is generally rectangular for fitting a register cover. The system may further include a fitting having a first end and a second end, the first end having a round opening and a second opening having an oval cross-section and a main body between the first end and the second end. The main body may be sized and shaped such that the round opening is presented orthogonally to the second opening. The system may further include a t-fitting having a first segment with a first opening attached to a second segment orthogonal to the first segment, the second segment having first and second opposite openings.

20 Claims, 13 Drawing Sheets

(56) References Cited

U.S. PATENT DOCUMENTS

| | | | | |
|---|---|---|---|---|
| 6,652,375 | B2 | 11/2003 | Donnelly | |
| 7,410,416 | B2 | 8/2008 | Fettkether | |
| 2003/0051764 | A1* | 3/2003 | Jungers | B29C 41/22 138/149 |
| 2003/0100258 | A1 | 5/2003 | Donnelly | |
| 2003/0177724 | A1 | 9/2003 | Botting | |
| 2004/0185772 | A1* | 9/2004 | Pilger | F24F 13/02 454/292 |
| 2006/0061104 | A1 | 3/2006 | Jungers | |
| 2008/0318514 | A1 | 12/2008 | Fettkether | |
| 2010/0071797 | A1* | 3/2010 | Jungers | F16L 59/145 138/141 |
| 2010/0201121 | A1* | 8/2010 | Jensen | F24F 13/0209 285/189 |
| 2013/0020798 | A1* | 1/2013 | Wallin | F16L 31/00 285/133.11 |
| 2015/0204622 | A1* | 7/2015 | Gray | B32B 5/18 165/135 |
| 2019/0049059 | A1* | 2/2019 | Jensen | B29C 48/152 |
| 2019/0390870 | A1* | 12/2019 | Fellinger | B23D 45/10 |

* cited by examiner

OVAL REGISTER BOOT, PIPE, ELBOW, AND CONNECTOR FOR HVAC

PRIORITY STATEMENT

This application claims priority to U.S. Provisional Patent Application 62/990,322, filed on Mar. 16, 2020, entitled OVAL REGISTER BOOT, PIPE, ELBOW, AND CONNECTOR FOR HVAC, hereby incorporated by reference in its entirety.

FIELD OF THE INVENTION

The present invention relates to heating and cooling. More particularly, but not exclusively, the present invention relates to a complete plastic HVAC component system for distributing air where oval plastic piping and corresponding fittings are used.

BACKGROUND

A common problem in heating and cooling is efficiency. Increasing efficiency of a heating and cooling system results in decreased costs of operating the system. A key contributing factor is efficiency loss as air travels from the heating or cooling source through ductwork ultimately to the various distribution points.

Conventionally, ductwork between the heating source (e.g., furnace) and the distribution points has been formed from sheet metal. Ducts or pipes as well as fittings such as elbows, couplers and boots are formed of riveted or welded sheet metal. More recently, flex pipe has been used to replace sheet metal ductwork. In addition, U.S. Pat. No. 7,410,416 to Fettkether, herein incorporated by reference in its entirety, discloses the use of 6- or 7-inch circular plastic piping.

Despite these improvements, problems remain. What is needed is improved HVAC component system for distributing air.

SUMMARY

Therefore, it is a primary object, feature, or advantage of the present invention to improve over the state of the art.

It is a further object, feature, or advantage of the present invention to provide plastic HVAC components having an oval cross-section in order to improve air flow and efficiency.

It is a still further object, feature, or advantage of the present invention to provide plastic HVAC components which may be placed within a wall such as an outer wall of a home or building or an internal wall all of a home or building.

Another object, feature, or advantage of the present invention is to provide plastic HVAC components to avoid risks of injury such as may occur with the handling of metal ductwork.

Yet another object, feature, or advantage of the present invention is to provide plastic HVAC components which avoid rust and are resistant to mold.

A still further object, feature, or advantage is to provide plastic pipes and fittings with an oval cross-section which may be integrated into a system of air flow handling which includes circular plastic pipes and fittings and/or metal ductwork and/or flex-pipe.

One or more of these and/or other objects, features, or advantages of the present invention will become apparent from the specification and claims that follow. No single embodiment need provide each and every object, feature, or advantage. Different embodiments may have different objects, features, or advantages. Therefore, the present invention is not to be limited to or by any objects, features, or advantages stated herein.

According to one aspect, a system for air handling, the system includes a pipe comprised of plastic having an oval cross-section. The system may further include a register boot comprised of plastic having a main body with a first opening and a second opening wherein the first opening has an oval cross-section for connection with an oval pipe and wherein the second opening is generally rectangular for fitting a register cover. The system may further include a fitting having a first end and a second end, the first end having a round opening and a second opening having an oval cross-section and a main body between the first end and the second end. The main body may be sized and shaped such that the round opening is presented orthogonally to the second opening. The system may further include a t-fitting having a first segment with a first opening attached to a second segment orthogonal to the first segment, the second segment having first and second opposite openings.

According to another aspect, a system for air handling is provided. The system includes an oval pipe comprised of plastic having an oval cross-section and a register boot comprised of plastic having a main body with a first opening and a second opening wherein the first opening has an oval cross-section for connection with the oval pipe and wherein the second opening is generally rectangular for fitting a register cover. The system may further include a fitting having a first end and a second end, the first end having a round opening and a second opening having an oval cross-section and a main body between the first end and the second end. The main body may be sized and shaped such that the round opening is presented orthogonally to the second opening. The system may further include at least one fitting having a first segment with a first opening attached to a second segment orthogonal to the first segment, the second segment having first and second opposite openings. The system may further include a round pipe having a round cross-section, the round pipe formed of plastic and having a diameter of 4 inches or less. The system may further include insulating foam sprayed annularly around a main body of the oval pipe. The oval cross-section may have a major axis of 6 inches. The oval cross-section may have a minor axis of 3 inches. The oval pipe may be positioned between framing members extending vertically along a wall of a building. The wall of the building may be an outer wall of the building. The system may further include a heating or cooling source configured for suppling heated or cooled air to the oval pipe.

According to another aspect, a method for installing duct work within a building is provided. The method includes providing a system for air handling, the system comprising an oval pipe comprised of plastic having an oval cross-section and a register boot comprised of plastic having a main body with a first opening and a second opening wherein the first opening has an oval cross-section for connection with an oval pipe and wherein the second opening is generally rectangular for fitting a register cover. The method may further include connecting the oval pipe with the register boot, positioning the oval pipe in between framing members extending vertically along a wall of the building, and securing the register boot to the wall. The wall of the building may be an outer wall of the building. The method may further include providing at least one of a heating and a cooling source and fluidly connecting the at least one of the heating and the cooling source to the oval pipe. The heating source may be a furnace and the cooling source may be an air conditioner.

According to another aspect, a system for air handling is provided. The system includes an oval pipe comprised of plastic having an oval cross-section with a major axis of 6 inches and a minor axis of 3 inches. The system further includes a register boot comprised of plastic having a main body with a first opening and a second opening wherein the first opening has an oval cross-section for connection with the oval pipe and wherein the second opening is generally rectangular for fitting a register cover. The system further includes a heating or cooling source configured for suppling heated or cooled air to the oval pipe and fluidly connected to the oval pipe. The system may further include a fitting having a first end and a second end, the first end having a round opening and a second opening having an oval cross-section and a main body between the first end and the second end. The main body may be sized and shaped such that the round opening is presented orthogonally to the second opening. The system may further include at least one fitting having a first segment with a first opening attached to a second segment orthogonal to the first segment, the second segment having first and second opposite openings. The system may further include a round pipe having a circular cross-section formed of plastic and having a diameter of 4 inches or less. The system may further include insulating foam sprayed annularly around a main body of the oval pipe.

BRIEF DESCRIPTION OF THE DRAWINGS

Illustrated embodiments of the disclosure are described in detail below with reference to the attached drawing figures, which are incorporated by reference herein.

DETAILED DESCRIPTION

Figure 1:
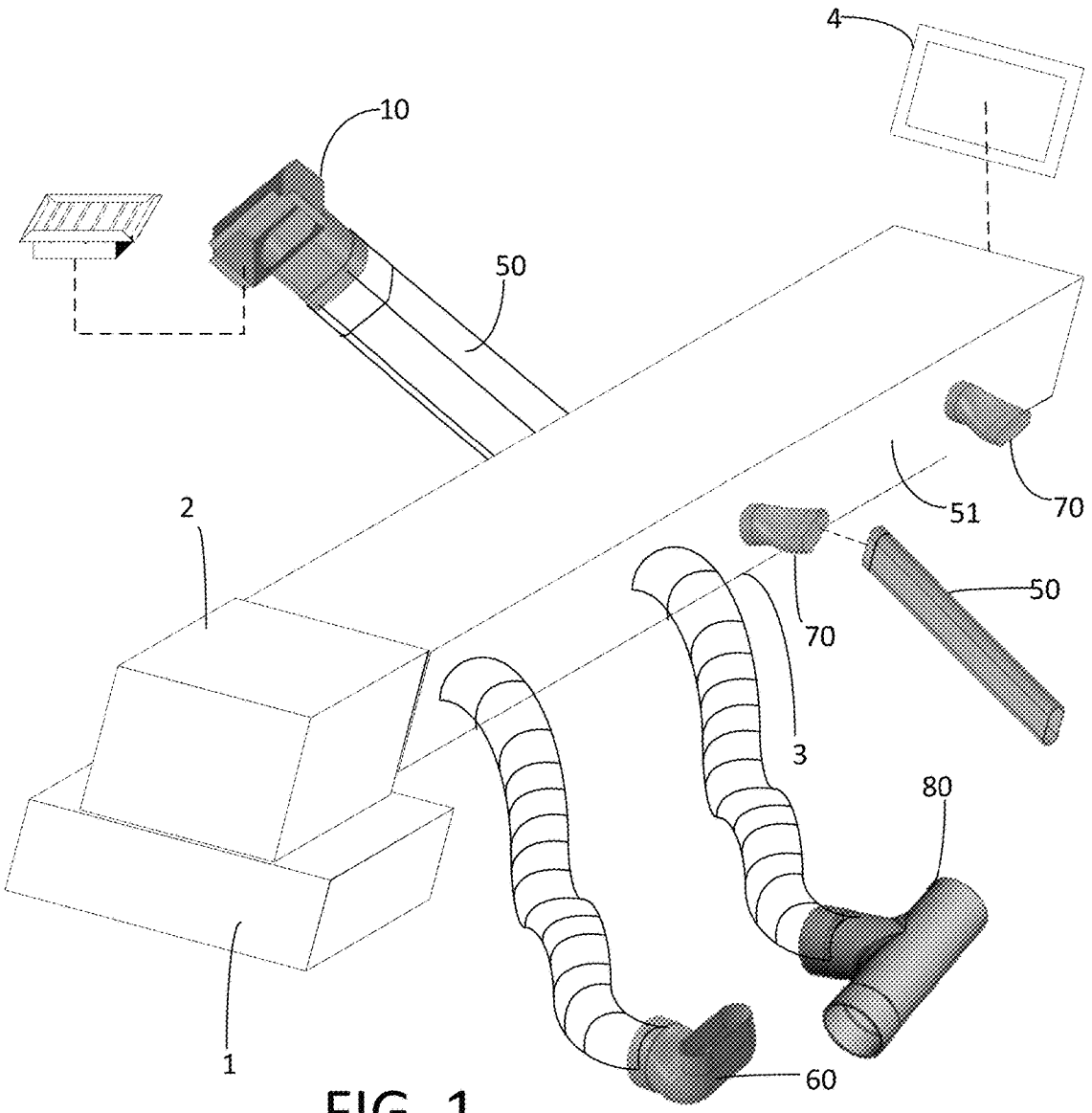
FIG. 1 is a pictorial representation of an HVAC system with plastic oval pipes and plastic fittings.

The present invention provides a complete plastic HVAC component system for distributing air and related methods for installing same. FIG. 1 illustrates one embodiment of a heating and cooling system that uses various embodiments of the component parts of the present invention.

In FIG. 1, an example of a heating or cooling source, in this instance, a furnace 1 is shown which has a plenum 2 with a duct 3 extending outwardly from the plenum 2. The duct 3 is capped using an end cap 4. Duct openings are present along the duct wall 51. Different examples of fittings are shown along the duct 3. An oval cross-section plastic pipe 50 is shown. One of the pipes 50 terminates in a register boot 10.

Figure 2:
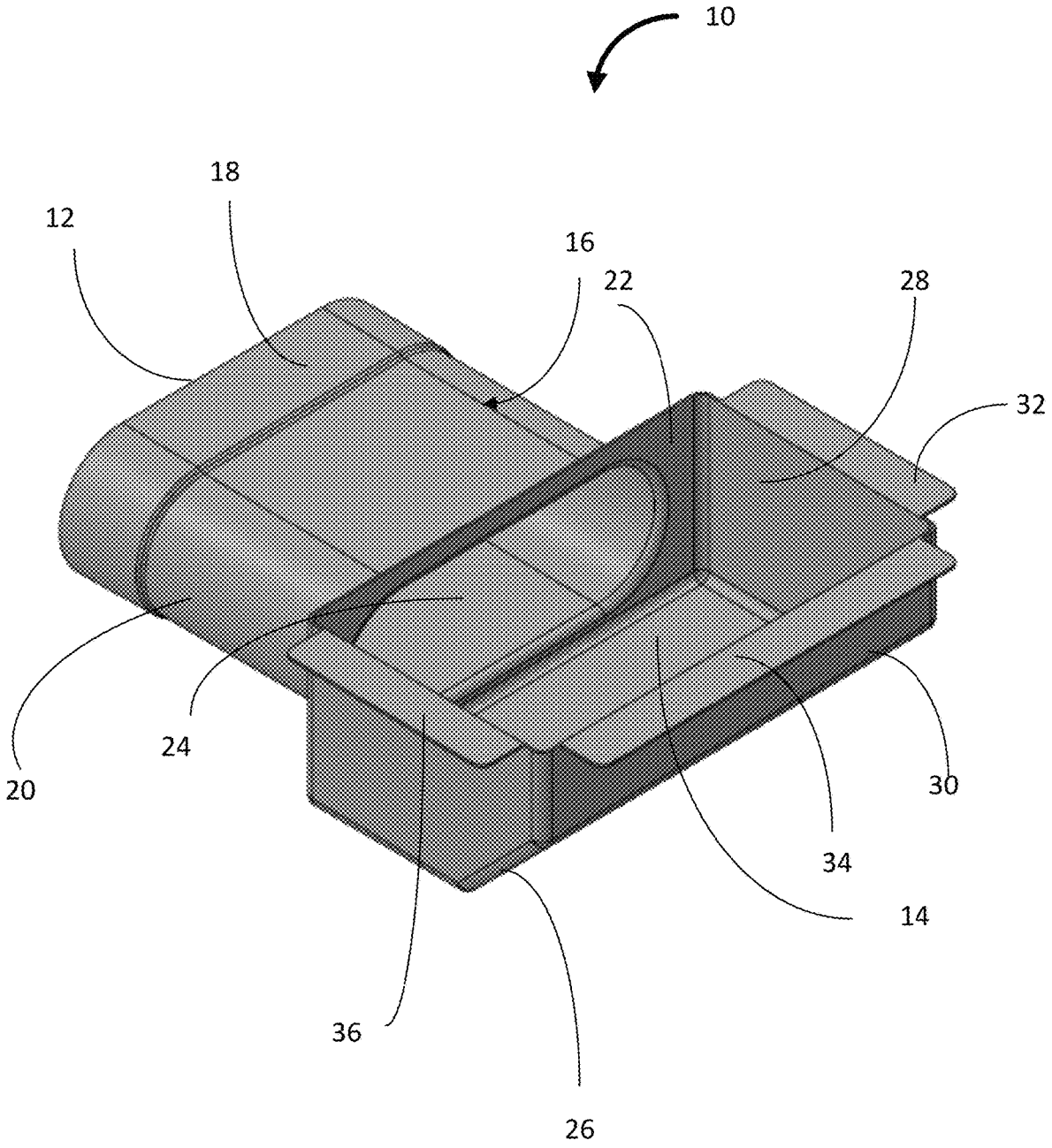
FIG. 2 is a perspective view of a plastic register boot for fitting an oval pipe.

FIG. 2 illustrates one example of a plastic register boot 10. The plastic register boot 10 is configured for connecting at 90-degree angle from the opening 12 where air enters the plastic register boot 10 to the opening 14 into which a rectangular register (not shown) may fit. The register boot 10 has a unitary body 16 which is preferably formed of plastic. The plastic is preferably an injection molded thermoplastic but may be formed in alternatives manners if desired. The register boot 10 has a substantially oval first opening 12 for connecting to oval pipe. The plastic register boot 10 has a substantially rectangular second opening 14 for connection to a register (not shown). Thus, air from the oval pipe may pass through the register boot 10 and to a register. Due to the unitary plastic construction, the register boot 10 is seamless thereby preventing loss of air within the register boot 10 itself. Thus, the unitary plastic construction is generally advantageous over a multi-piece construction. A multi-piece construction would also tend to increase the labor required in installing the register boot.

The register boot 10 has a first oval portion 18 which may be used to connect with an oval pipe such as by fitting over an end of an oval pipe. A second oval portion 20 extends outwardly therefrom to a wall 22 of a box with an opening 24 corresponding to the oval portion. The box includes an open top or opening 14 and first and second opposite side walls 26, 28 and a front wall 30. There are also tabs 32, 34, 36 extending orthogonally outward from the side walls 28, 26 and the front wall 30.

It is to be understood that the oval cross-section of the pipe is advantageous in promoting the efficiency of the HVAC system in moving air throughout oval piping to distribution points including to the register boot 10.

Figure 3:
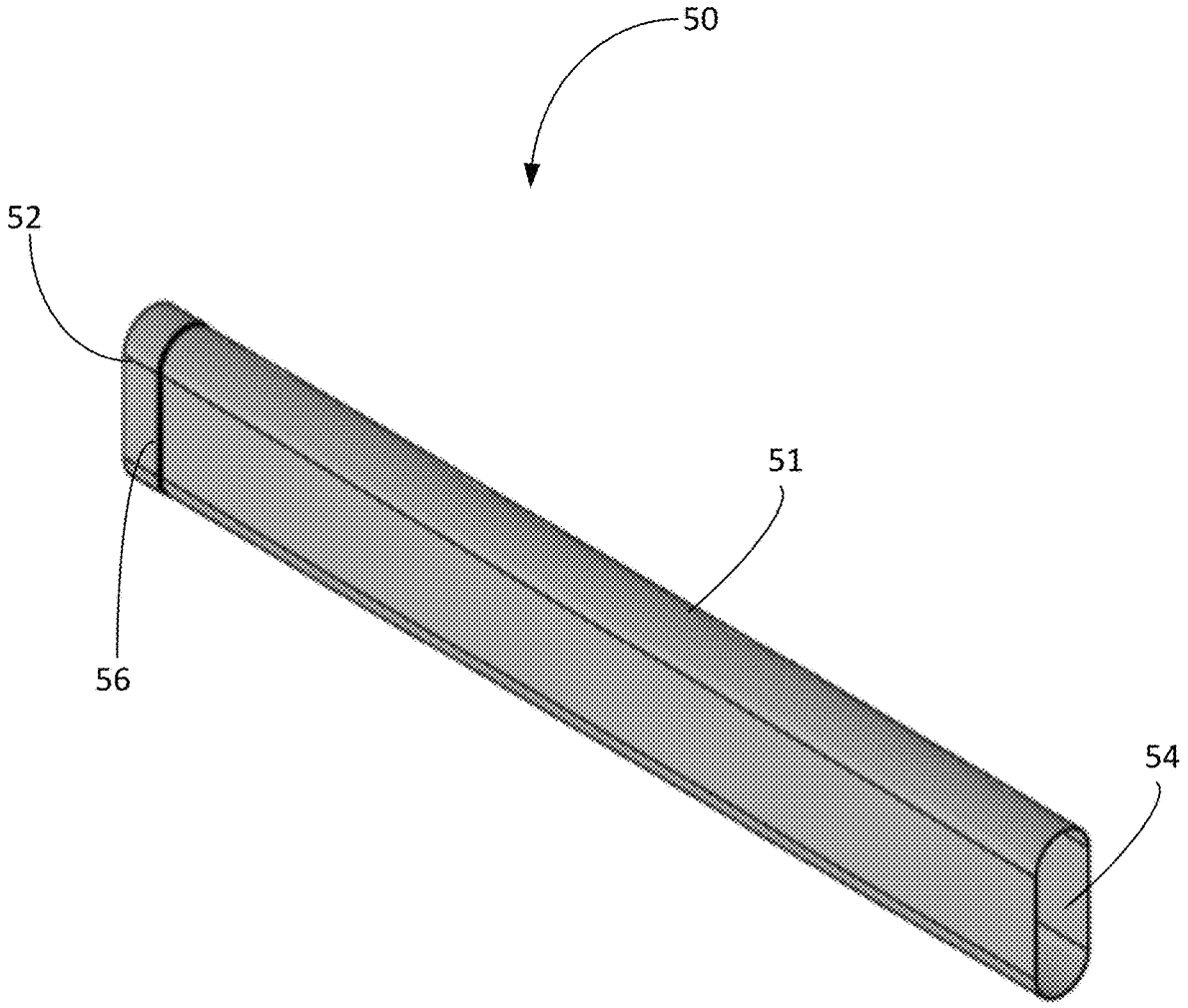
FIG. 3 is perspective view of a straight piece of oval pipe.

FIG. 3 illustrates a section of oval piping 50 having a first end 52 and an opposite second end 54. At the first end 52 an end portion 56 of the oval piping 50 is sized and shaped to fit over an opposite end of another section of the oval piping. The section of oval piping 50 has main body 51 extending between the end portion 56 and the second end 54.

Figure 4:
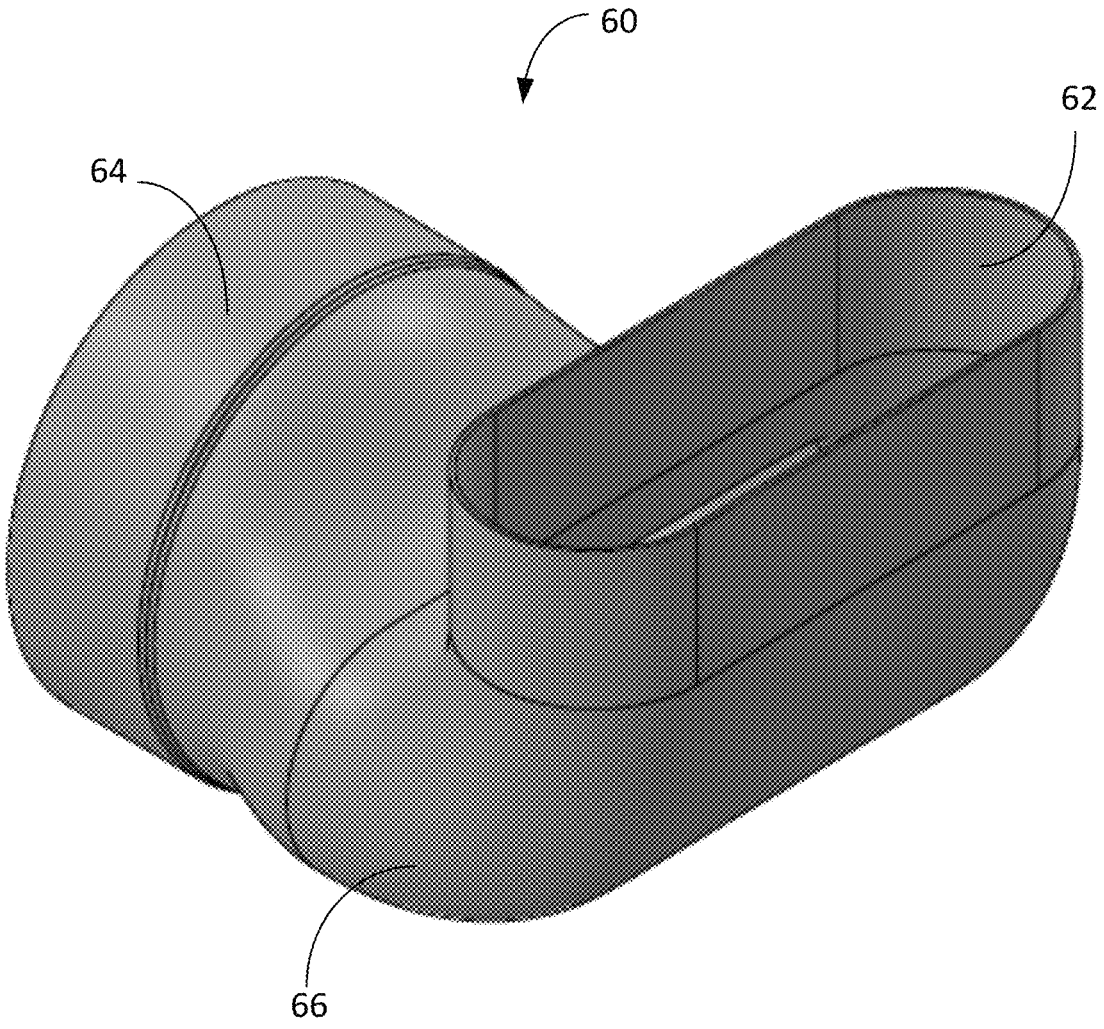
FIG. 4 is a perspective view of a plastic 90-degree circular to oval pipe fitting.

FIG. 4 illustrates an example of a fitting 60 which provides a 90-degree connection between a circular pipe or fitting or flex pipe and an oval pipe or fitting. At the first end 64, the fitting is generally circular in shape. The main body 66 extends from the circular opening at a 90-degree angle to terminate at the second end 62 which has an oval or oblong opening.

Figure 5:
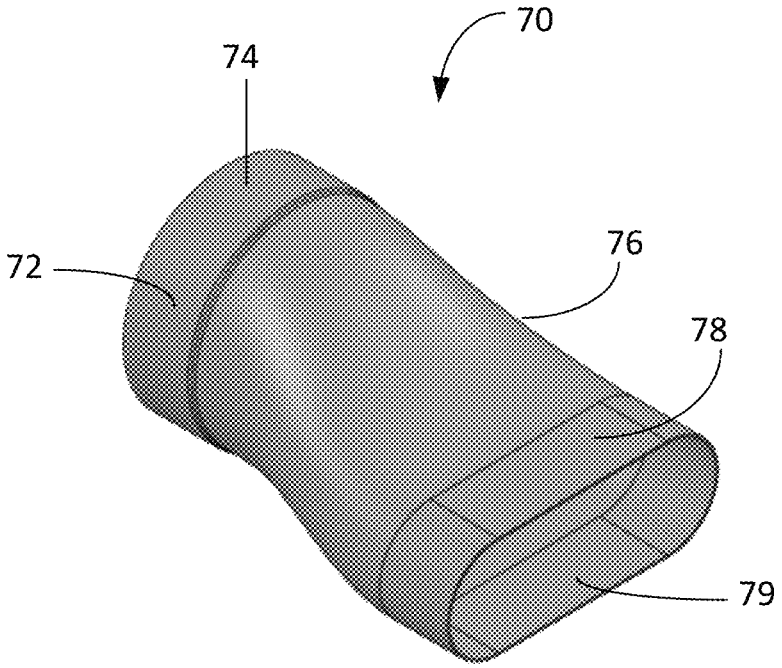
FIG. 5 is a perspective view of a plastic straight circular to oval pipe fitting.

FIG. 5 illustrates another example of a fitting 70 which may be appropriate for adapting between a circular pipe or fitting and an oval pipe or fitting. At the first end 72, the adapter is generally circular in shape with a portion 74 sized to fit over a cylindrical pipe or fitting or flex pipe. The main body 76 extends from the circular opening to terminate at the second end 78 sized to fit into an oval pipe which has an oval or oblong opening 79.

Figure 6:
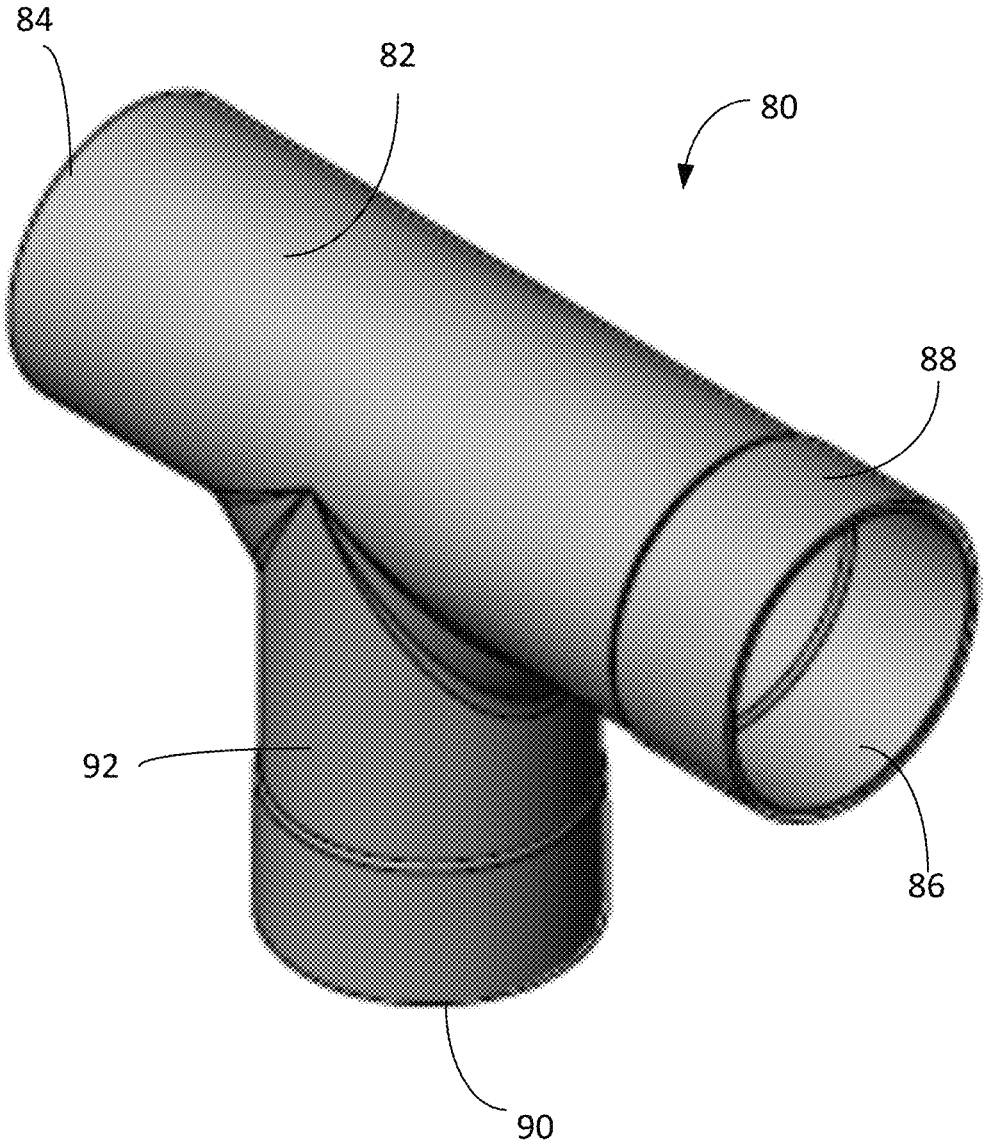
FIG. 6 is a perspective view of a plastic t-fitting for circular pipe.

FIG. 6 illustrates another example of a plastic pipe fitting. The pipe fitting 80 is T-shaped, having a first segment 82 with a first opening 84 on one end and a second opening 86 on an opposite end. The end portion at the second opening 86 is sized to allow a cylindrical pipe or fixture to fit over it. The second segment 92 is orthogonally positioned relative to the first segment thereby form a T-shape. The second segment 92 has an opening 90 which may fit over another cylindrical pipe or fixture. Although a cylindrical plastic pipe fitting is shown, the present invention further contemplates than an oval plastic pipe fitting may be used. In some embodiments, the first opening and the second opening on the first segment may both be cylindrical in shape.

The oval piping of the present invention is advantageous in that it is more conducive to fitting within a wall (e.g., a 6-inch wall) without having to a hole within the wall. Thus, the oval pipe may be positioned within the wall coming down from a ceiling or coming up from the basement floor. By having an oval pipe traveling through an inside wall of a building it allows for heating/cooling to occur faster than an outside wall. It is also advantageous in tight areas where it replaces traditional ductwork. It also improves efficiency to use on an inside wall relative to an outside wall. In addition, the plastic nature avoids mold or dust or pollen build up which can be highly advantageous for certain individuals.

The oval pipe and the joints and fittings are also advantageous in that they do not use sheet metal screws which may lead to injury. Thus, installers carrying workers compensation insurance may see reductions in insurance rates due to the added safety of replacing metal with plastic avoiding the opportunity to cut hands, arms, and fingers. This also allows installers to reduce the labor required on a given job.

The present invention also provides for providing circular piping having a diameter of about four inches. This size of piping is advantageous in that it may fit within walls or may fit within recreational vehicles, mobile homes, construction offices, or other structures where space is limited.

Figure 7:
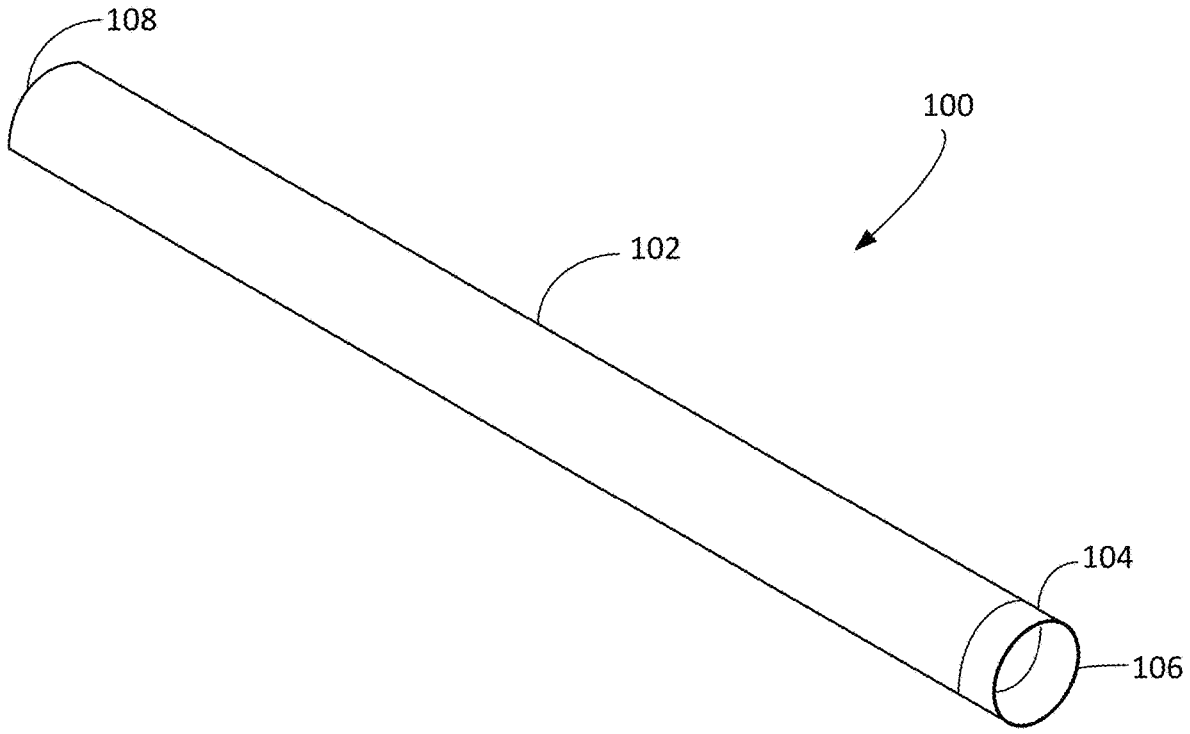
FIG. 7 illustrates a section of 4-inch diameter circular piping.

FIG. 7 illustrates a section of 4-inch diameter circular piping. The section of pipe 100 has a main body 102 with first and second opposite ends 106 and 108. An end portion 104 is shown at the end 106 for receiving another section of piping or pipe fitting.

Figure 8:
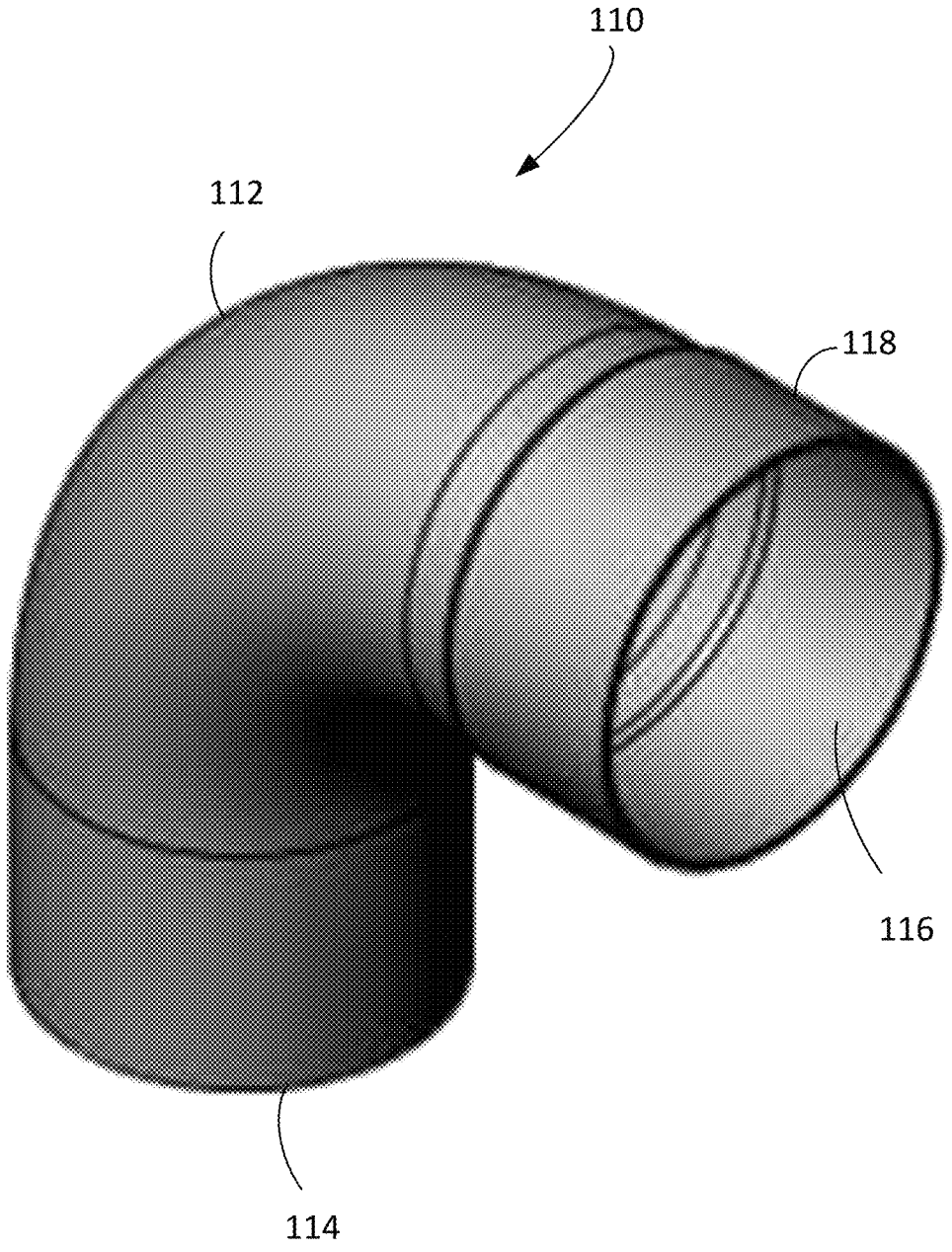
FIG. 8 illustrates an elbow for 4-inch diameter circular piping.

FIG. 8 illustrates an elbow 110 for 4-inch diameter circular piping. The elbow 110 has a main body 112 which is configured with a 90 degree turn such that opening 114 and 116 are orthogonal to one another. An end portion 118 is shown at one end for additional piping or fixtures to fit over while the opposite opening 114 may fit other the ends of other piping or fixtures.

Figure 9:
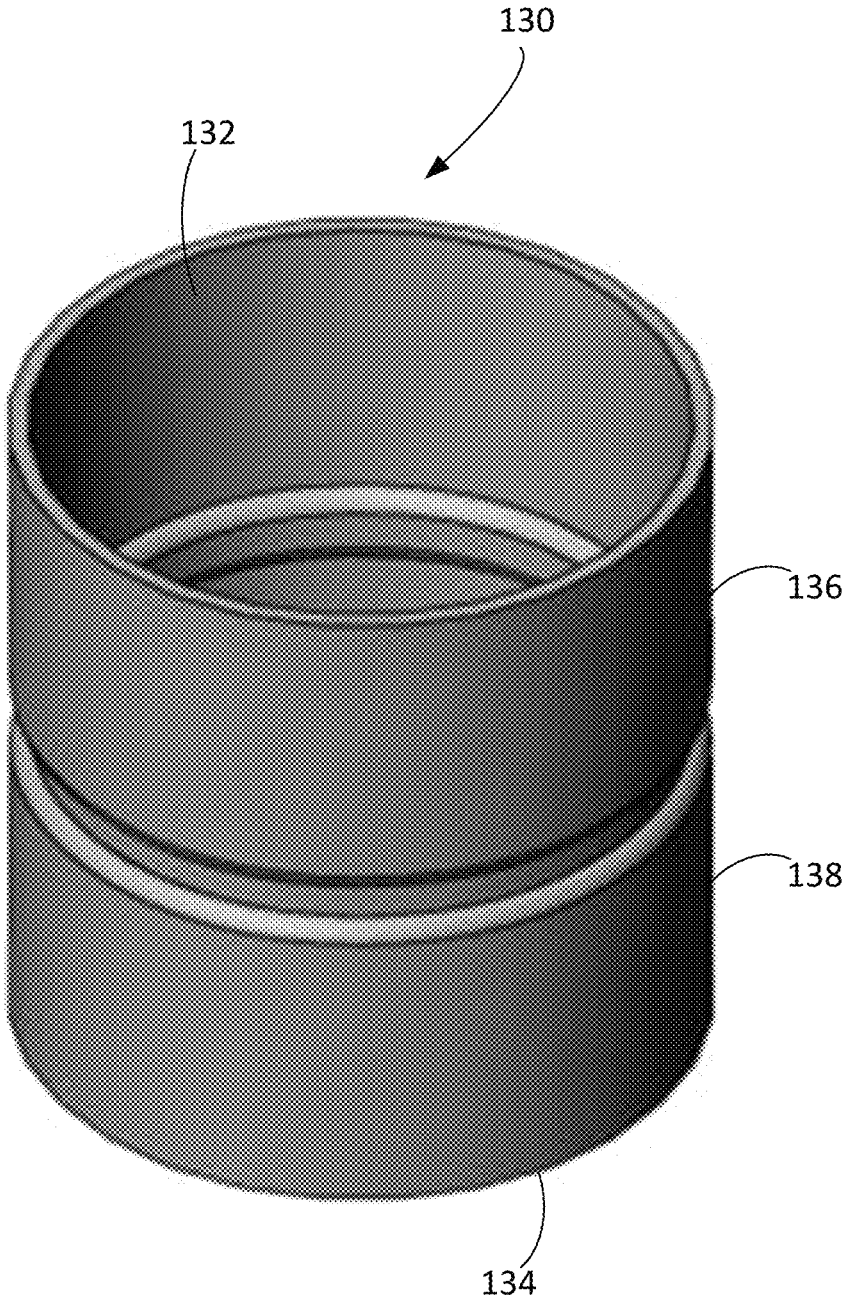
FIG. 9 illustrates a 4-inch round or coupling adapter.

FIG. 9 illustrates a four-inch round or coupling adapter 130. The adapter has a first end portion 136 with a first opening 132 and a second end portion 138 with a second end portion 134. The coupling adapter 130 is configured to couple sections of cylindrical pipe or fittings together.

Figure 10:
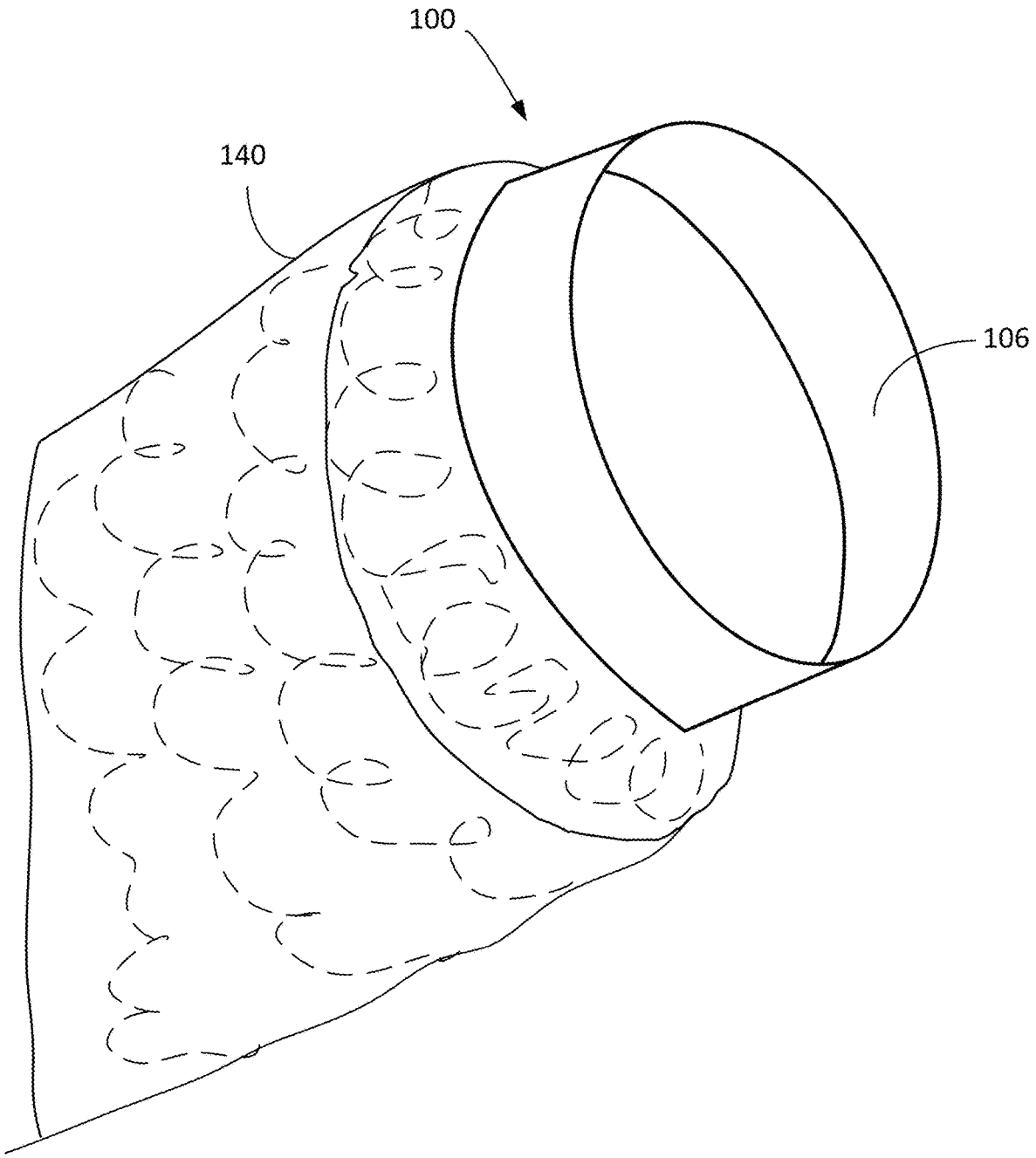
FIG. 10 illustrates a section of circular pipe which has been spray foamed.

FIG. 10 illustrates a section of circular pipe which has been spray foamed. The pipe 100 has an opening 106. Spray foam 140 is deposited around a main body of the pipe to provide for insulation.

Figure 11:
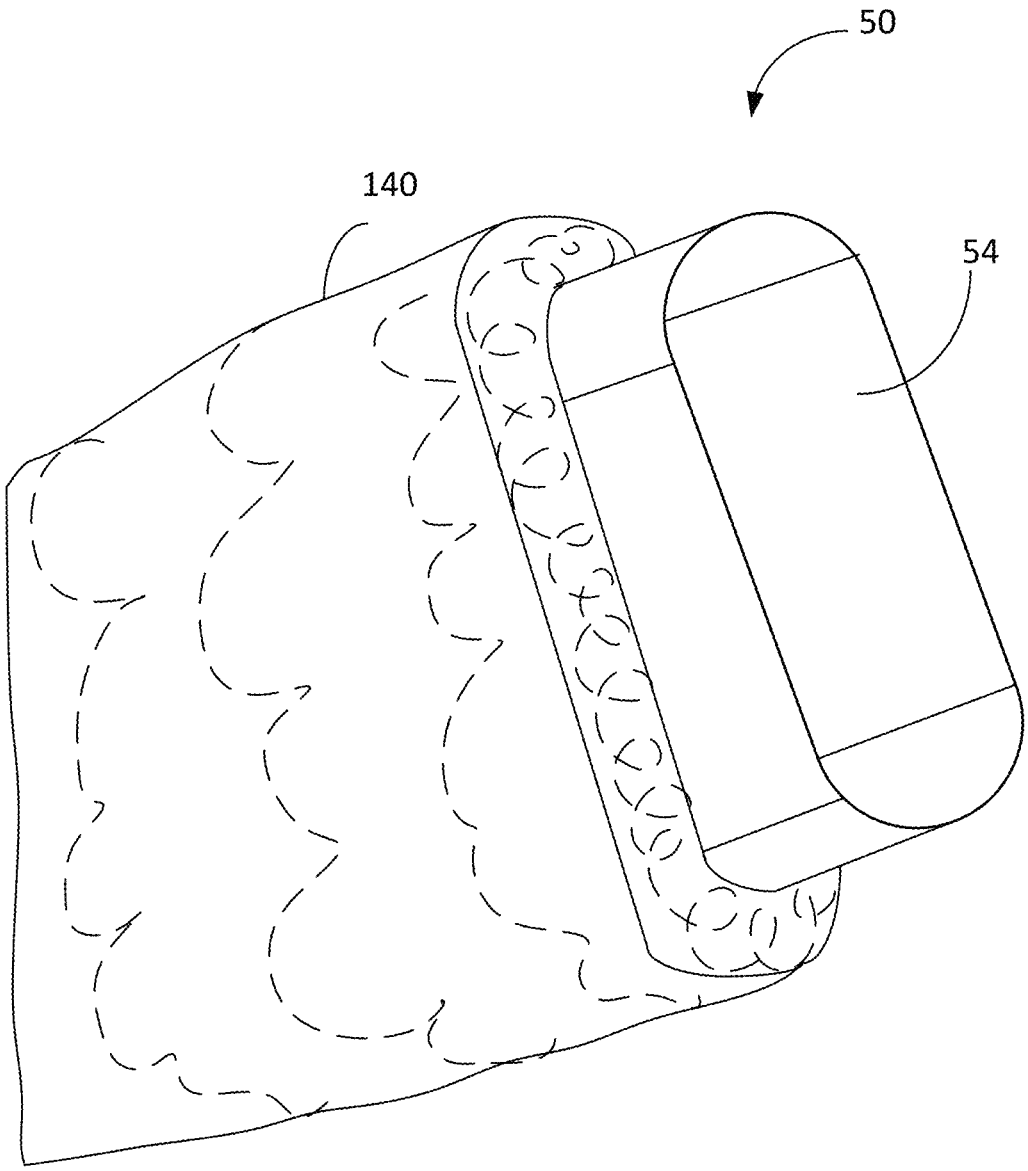
FIG. 11 illustrates a section of oval pipe which has been spray foamed.

FIG. 11 illustrates a section of oval pipe which has been spray foamed. The pipe 50 has an opening 54. Spray foam 140 is deposited annularly around a main body of the pipe to provide for insulation.

Figure 12:
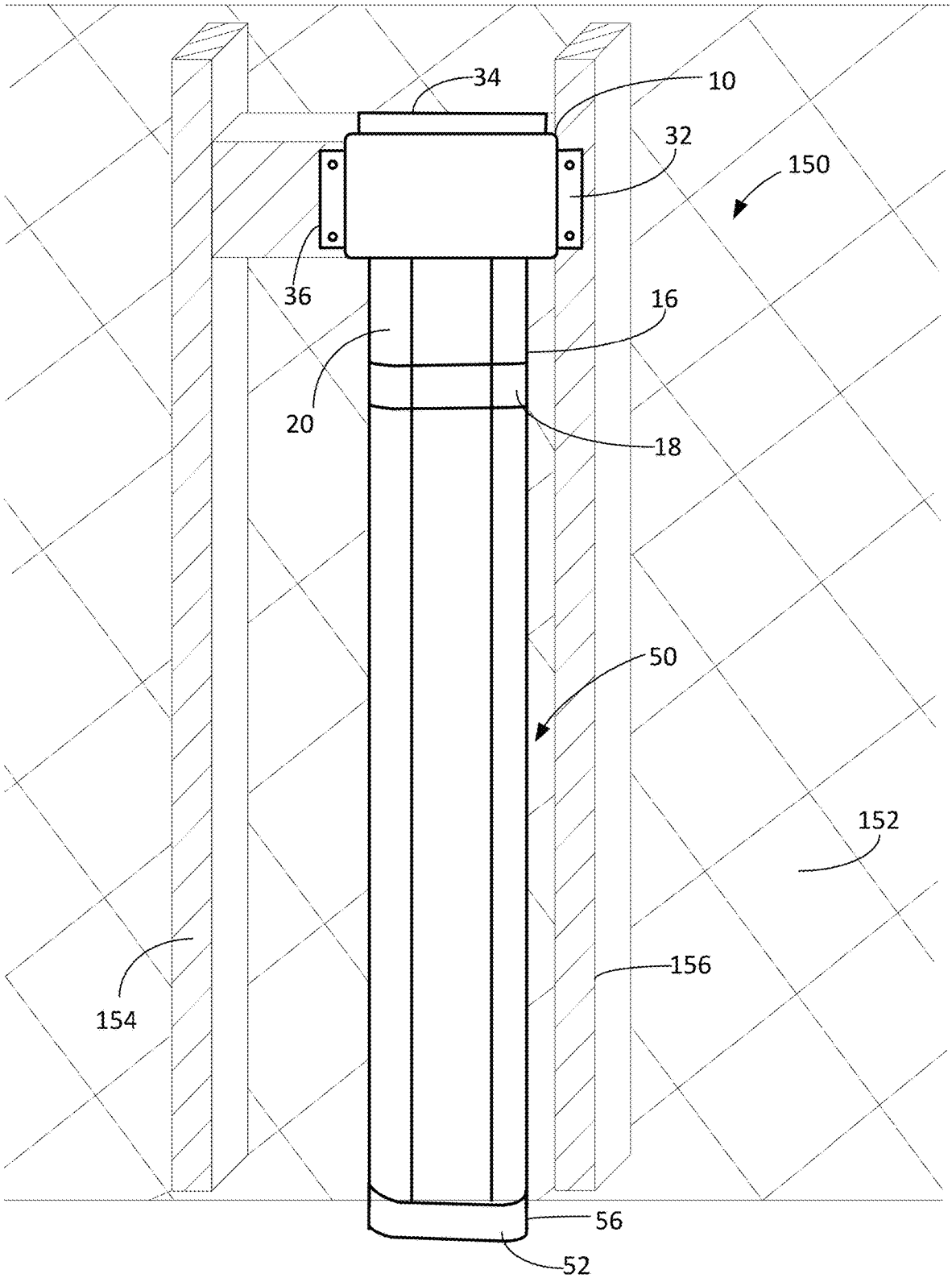
FIG. 12 illustrates a section of circular pipe and a register boot.

FIG. 12 illustrates a section of circular pipe and a register boot. This section of pipe may run upward between 2×4" inch framing of a home such as along an external wall 152 of a house or other building. The 2×4" framing may include studs 154 and 156. Note that the oval pipe section 50 is sufficiently small that it can fit between the studs 154, 156. What is more, is that this oval pipe section 50 (which may be extended with additional pipe sections) may run upwardly such as to a second floor of a home. A register boot 10 such as shown in FIG. 2 may be positioned at the top.

Figure 13:
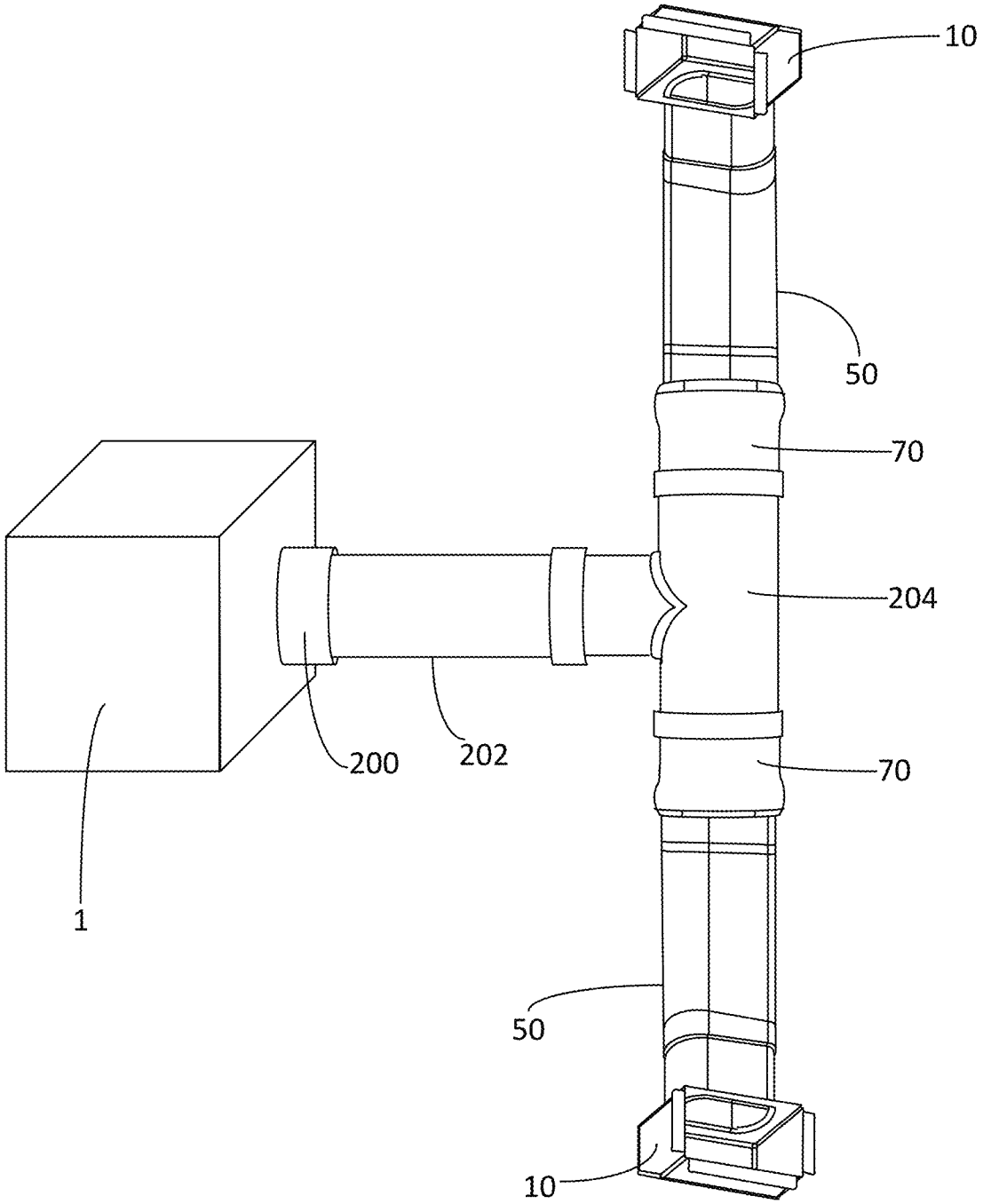
FIG. 13 illustrates another pictorial representation of an HVAC system with plastic oval pipes and plastic fittings.

In FIG. 13, an example of a heating or cooling source, in this instance, a furnace 1 is shown. A cylindrical fitting 200 is shown connected to the furnace. A cylindrical pipe section 202 extends from the fitting 200 and terminates in a T fitting 204. On opposite ends of the T fitting 204 are adapters 70 for transitioning from circular fittings to oval-fittings. Oval pipe sections 50 are shown which each terminate in registers boots 10. This is one example of a configuration which may be obtained using all plastic pipe and fixtures and using a combination of circular and oval-shaped fittings and pipes. It is to be understood that, however, that in some applications, oval-shaped fittings are preferred as they, can for example, fit between wall studs along a wall and have a greater cross-section than a small (e.g., 4-inch diameter circular pipe).

Various pipe sections and fittings are contemplated. This may include a 6 inch round pipe of a 5 foot length: a 6 inch round register boot for fitting a 4 inch by 10 inch register; a 6 inch round register boot for fitting a 2½ inch by 12 inch register; a 6 inch round coupling/adapter; a 6 inch round register boot for fitting a 4 inch by 12 inch register; a 6 inch 90 degree collar; a 6 inch round 90 degree collar; a 6 inch round straight collar; a 6 inch round torpedo boot for 4 inch by 10 inch register; a 6 inch round torpedo boot for a 2% inch by 12 inch register; a 6 inch round torpedo boot for fitting a 4 inch by 12 inch register; a 6 inch round elbow at 45 percent; a 4 inch round pipe with a 10 foot length; a 4 inch round coupler/adapter; a 4 inch round tee, a 4 inch register boot with 2% inch by 10 inch; a 4 inch elbow; a 6 inch oval pipe with a 3 inch and 5 foot height; a 6 inch oval adapter (3 inch by 5 foot); a 6 inch oval register boot (3 inch×8 inch to 6 inch by 10 inch); and a 6 inch oval elbow. Of course, other types, lengths, and styles of pipes and fittings are contemplated.

In operation, a system comprised of various components including pipes and fittings may be installed. The system such as shown in FIG. 1 or in FIG. 13 may include a combination of plastic pipe including round plastic pipe, oval plastic pipe, and flexi-pipe. The specific combinations of pipes used in an installation in a home or other building may be based on a number of different factors and considerations. This may include the amount of heating or cooling associated with a particular room. For example, a smaller room or room not used often may not need as much heating or cooling and so only a single register and register return may be needed for the room. The specific combination of pipes and fittings may take into consideration where the room is located relative to the nearest furnace or air-conditioning unit. The specific combination of pipes and fittings may also take into consideration where in the building the room is located such as on what floor. In many installations, it is beneficial to provide one or more oval pipes and mating fittings. For example, if the room is on the second floor along an outside wall and a limited amount of heating or cooling is required, then one or more sections of oval pipe may be placed between vertically extending framing members or studs that run upwards along the wall. The one or more sections of oval pipe may then terminate at a register boot.

Thus, to install duct work within a method for heating and cooling, first a determination may be made as to the particular component parts of the system to install. This may include an oval pipe comprised of plastic having an oval cross-section and a register boot comprised of plastic having a main body with a first opening and a second opening wherein the first opening has an oval cross-section for connection with an oval pipe and wherein the second opening is generally rectangular for fitting a register cover. The system to install may also include number other sections of pipe, register boots, and fittings. These other pipes and fittings need not all be of oval cross-section but may also include pipe and fittings with round cross-sections, flex-pipes, and traditional duct work (including metal duct work). For example, in an existing installation where some metal ductwork is used, it may not be desired to replace all metal ductwork. In a new installation it may be desired to connect plastic pipes and fittings directly to the output of a furnace, for example. Once, the necessary component parts are provided, they may be installed. For example, a section of oval pipe may be connected to a register boot. The section of oval pipe may be positioned at a desired location. One example of a desired location may be in between framing members or studs extending vertically along a wall of a building. The wall of the building may be an outer wall or an inner wall. The register boot may then be secured in place such as through use of fasteners such as screws. Other sections of pipe and pipe fittings may be installed in a similar manner depending on their type and location. It is to be understood that pipe sections and fittings may be secured together with adhesives and/or fasteners such as screws.

The invention is not to be limited to the particular embodiments described herein. In particular, the invention contemplates numerous variations in size, shape, and materials. The foregoing description has been presented for purposes of illustration and description. It is not intended to be an exhaustive list or limit any of the invention to the precise forms disclosed. It is contemplated that other alternatives or exemplary aspects are considered included in the invention. The description is merely examples of embodiments, processes, or methods of the invention. It is understood that any other modifications, substitutions, and/or additions can be made, which are within the intended spirit and scope of the invention.

What is claimed is:

1. A system for air handling, the system comprising:

an oval pipe comprised of plastic having an oval cross-section and having a major axis of 6 inches and a minor axis of 3 inches;

a register boot comprised of plastic having a main body with a first opening and a second opening wherein the first opening ahs an oval crossOsection for connection with the oval pipe and wherein the second opening is generally rectangular for fitting a register cover, the main body further comprising a first oval portion at the first opening sized to fit over an end of the oval pipe, a second oval portion extending outwardly from the first oval portion to a rear wall of a box having an opposite front wall and first and second opposite side walls, the register boot further comprising a first tab extending orthogonally outward from the first side wall, a second tab extending orthogonally outward from the second side wall, and a third tab extending orthogonally outward from the front wall;

wherein the first tab has a length less than the first side wall and is centered along the first side wall;

wherein the second tab has a length less than the second side wall and is centered along the second side wall;

wherein the third tab has a length less than the third side wall and is centered along the third side wall;

wherein the second oval portion defines an opening in the rear wall of the box, the opening in the rear wall of the box centered within the rear wall of the box, with a length of the rear wall longer than a major diameter of the opening in the rear wall of the box and with a width of the rear wall longer than a minor diameter of the opening within the rear wall of the box, the opening in the rear wall of the box centered in the rear wall of the box.

2. The system of claim 1 further comprising a fitting having a first end and a second end, the first end having a round opening and a second opening having an oval cross-section and a main body between the first end and the second end.

3. The system of claim 2 wherein the main body of the fitting is sized and shaped such that the round opening is presented orthogonally to the second opening.

4. The system of claim 1 further comprising at least one fitting having a first segment with a first opening attached to a second segment orthogonal to the first segment, the second segment having first and second opposite openings.

5. The system of claim 1 further comprising a round pipe having a round cross-section, the round pipe formed of plastic and having a diameter of 4 inches or less.

6. The system of claim 1 further comprising insulating foam sprayed annularly around a main body of the oval pipe.

7. A building comprising the system of claim 1 wherein the oval pipe is positioned between framing members extending vertically along a wall of the building.

8. The building of claim 7 wherein the wall of the building is an outer wall of the building.

9. The system of claim 1 further comprising a heating or cooling source configured for suppling heated or cooled air to the oval pipe.

10. The system of claim 1 wherein the first tab has a rounded first and second outer most corners, wherein the second tab has rounded first and second outer most corners, and wherein the third tab has rounded first and second outer most corners.

11. A method for installing duct work within a building, the method comprising:

providing a system for air handling, the system comprising an oval pipe comprised of plastic having an oval cross-section and a register boot, wherein the register boot is comprised of plastic having a main body with a first opening and a second opening wherein the first opening has an oval cross-section for connection with the oval pipe and wherein the second opening is generally rectangular for fitting a register cover, the main body further comprising a first oval portion at the first opening sized to fit over an end of the oval pipe, a second oval portion extending outwardly from the first oval portion to a rear wall of a box having an opposite front wall and first and second opposite side walls, the register boot further comprising a first tab extending orthogonally outward from the first side wall, a second tab extending orthogonally outward from the second side wall, and a third tab extending orthogonally outward from the front wall, wherein the first tab has a length less than the first side wall and is centered along the first side wall, wherein the second tab has a length less than the second side wall and is centered along the second side wall, and wherein the third tab has a length less than the third side wall and is centered along the third side wall, wherein the second oval portion defines an opening in the rear wall of the box, the opening in the rear wall of the box centered within the rear wall of the box, with a length of the rear wall longer than a major diameter of the opening in the rear wall of the box and with a width of the rear wall longer than a minor diameter of the opening within the rear wall of the box, the opening in the rear wall of the box centered in the rear wall of the box; connecting the oval pipe with the register boot by positioning the first oval portion of the register boot over an end of the oval pipe;

positioning the oval pipe in between framing members extending vertically along a wall of the building;

and securing the register boot to the wall such that the first tab, the second tab, and the third tab of the register boot fit against the wall.

12. The method of claim 11 wherein the wall of the building is an outer wall of the building.

13. The method of claim 11 further comprising providing at least one of a heating and a cooling source and fluidly connecting the at least one of the heating and the cooling source to the oval pipe.

14. A system for air handling, the system comprising: an oval pipe comprised of plastic having an oval cross-section with a major axis of 6 inches and a minor axis of 3 inches, a register boot comprised of plastic having a main body with a first opening and a second opening wherein the first opening has an oval cross-section for connection with the oval pipe and wherein the second opening is generally rectangular for fitting a register cover, the main body further comprising a first oval portion at the first opening sized to fit over an end of the oval pipe, a second oval portion extending outwardly from the first oval portion to a rear wall of a box having an opposite front wall and first and second opposite side walls, the register boot further comprising a first tab extending orthogonally outward from the first side wall, a second tab extending orthogonally outward from the second side wall, and a third tab extending orthogonally outward from the front wall, wherein the first tab has a length less than the first side wall and is centered along the first side wall, wherein the second tab has a length less than the second side wall and is centered along the second side wall, and wherein the third tab has a length less than the third side wall and is centered along the third side wall, wherein the second oval portion defines an opening in the rear wall of the box, the opening in the rear wall of the box centered within the rear wall of the box, with a length of the rearwall longer than a major diameter of the opening in the rear wall of the box and with a width of the rear wall longer than a minor diameter of the opening within the rear wall of the box, the opening in the rear wall of the box centered in the rear wall of the box;

a heating or cooling source configured for suppling heated or cooled air to the oval pipe and fluidly connected to the oval pipe.

15. The system of claim 14 further comprising a fitting having a first end and a second end, the first end having a round opening and a second opening having an oval cross-section and a main body between the first end and the second end.

16. The system of claim 15 wherein the main body is sized and shaped such that the round opening is presented orthogonally to the second opening.

17. The system of claim 14 further comprising at least one fitting having a first segment with a first opening attached to a second segment orthogonal to the first segment, the second segment having first and second opposite openings.

18. The system of claim 14 further comprising a round pipe having a circular cross-section formed of plastic and having a diameter of 4 inches or less.

19. The system of claim 14 further comprising insulating foam sprayed annularly around a main body of the oval pipe.

20. The system of claim 14 wherein the first tab has a rounded first and second outer most corners, wherein the second tab has rounded first and second outer most corners, and wherein the third tab has rounded first and second outer most corners.

* * * * *